US010902981B2

(12) United States Patent
Schall

(10) Patent No.: US 10,902,981 B2
(45) Date of Patent: Jan. 26, 2021

(54) METHOD FOR DETERMINING THE OPERATING STATE OF A PTC THERMISTOR ELEMENT

(71) Applicant: Mahle International GmbH, Stuttgart (DE)

(72) Inventor: Matthias Schall, Ostfildern (DE)

(73) Assignee: Mahle International GmbH

( * ) Notice: Subject to any disclaimer, the term of this patent is extended or adjusted under 35 U.S.C. 154(b) by 0 days.

(21) Appl. No.: 16/415,516

(22) Filed: May 17, 2019

(65) Prior Publication Data

US 2019/0355497 A1 Nov. 21, 2019

(30) Foreign Application Priority Data

May 17, 2018 (DE) ..... 10 2018 207 777

(51) Int. Cl.
*H01C 7/00* (2006.01)
*H05B 3/12* (2006.01)
*H01C 7/02* (2006.01)

(52) U.S. Cl.
CPC ..... *H01C 7/008* (2013.01); *H01C 7/02* (2013.01); *H05B 3/12* (2013.01)

(58) Field of Classification Search
CPC ..... H01C 7/008; H01C 7/02; H05B 3/12
See application file for complete search history.

(56) References Cited

U.S. PATENT DOCUMENTS 5,765,511 A * 6/1998 Schatz ..... B60H 1/00492 123/41.14
2008/0264609 A1* 10/2008 Lutz ..... F28D 7/0091 165/104.19
2012/0297765 A1* 11/2012 Vigild ..... F01P 3/20 60/599
2013/0025295 A1* 1/2013 Brehm ..... B60N 2/5692 62/3.6
2015/0034626 A1* 2/2015 Kominami ..... H05B 1/0236 219/483

(Continued)

FOREIGN PATENT DOCUMENTS

EP 2732995 A1 5/2014

OTHER PUBLICATIONS

EP2732995; machine translation. (Year: 2012).*
English abstract for EP-2732995.
German Search Report for DE-102018207777.0, dated May 20, 2019.

*Primary Examiner* — Kyung S Lee
(74) *Attorney, Agent, or Firm* — Fishman Stewart PLLC

(57) ABSTRACT

A method for determining an operating state of a PTC thermistor element may include pre-setting a released electric output available to the PTC thermistor element via a control signal and superimposing the control signal, at least for a pre-set period of time, with an additional signal which has a pre-set time profile. The method may also include, during the pre-set period of time, determining one of a time profile of a consumed electric output of the PTC thermistor element and a time profile of a consumed operating current of the PTC thermistor element. The method may also include comparing the pre-set time profile of the additional signal and the one of the time profile of the consumed electric output of the PTC thermistor element and the time profile of the consumed operating current of the PTC thermistor element.

20 Claims, 3 Drawing Sheets

(56) References Cited

U.S. PATENT DOCUMENTS

| | | | | |
|---|---|---|---|---|
| 2015/0323391 | A1* | 11/2015 | McCulloch | G05D 23/1931 374/185 |
| 2016/0318499 | A1* | 11/2016 | Yamanaka | B60L 58/27 |
| 2016/0368347 | A1* | 12/2016 | Pierron | H05B 3/50 |
| 2019/0225053 | A1* | 7/2019 | Dienhart | H05B 3/00 |
| 2019/0387581 | A1* | 12/2019 | Kohl | H01C 1/1406 |

* cited by examiner

METHOD FOR DETERMINING THE OPERATING STATE OF A PTC THERMISTOR ELEMENT

CROSS-REFERENCE TO RELATED APPLICATION

This application claims priority to German Application No. DE 10 2018 207 777.0, filed on May 17, 2018, the contents of which are hereby incorporated by reference in its entirety.

TECHNICAL FIELD

The present invention relates to a method for determining the operating state of a PTC thermistor element and to a method for operating an electric heating device of a vehicle.

BACKGROUND

Electric heating devices with PTC thermistor elements are utilised in modern vehicles in order to heat outside air, which is supplied into an interior space of the vehicle, to a temperature that is pleasant for the occupants.

An operating voltage is applied to the PTC thermistor elements which serve as heating resistors in order to convert electric energy into heat energy and thereby provide a desired heating output. PTC thermistor elements are temperature-dependent resistors with a positive temperature coefficient (PTC=positive temperature coefficient), wherein a non-linear relationship is present between the electrical resistance and the temperature of the PTC thermistor element.

An output control of the PTC thermistor element can be performed via power electronics assigned to the PTC thermistor element, wherein the released electric output that is available to the PTC thermistor element is preset or limited by the power electronics. The power electronics can supply the PTC thermistor element with an operating voltage and an operating current. The electric output released by the power electronics can be pre-set or controlled by a control signal. Here, the control signal can also be supplied to the power electronics externally from a control unit. A maximum electric output that is available to the PTC thermistor element can be determined. Activating the power electronics can also take place by means of a percentage specification of the maximum available electric output, wherein a percentage specification of 0% means that the PTC thermistor element has no electric output at its disposal and it is switched off. A percentage specification of 100% by contrast means that the PTC thermistor element has the maximum electric output at its disposal. It can be provided that the percentage specification needed for such an activation is preset by the control signal. It can also be provided that such a percentage specification is determined from the control signal. The control signal can be present as analogue signal or as digital signal.

A PTC thermistor element has a regular operating state and a critical operating state. The operating state that is present depends on the activation of the PTC thermistor element (of the released electric output), the air inlet temperature and the air quantity. When, because of the air-side peripheral conditions, more thermal output can be dissipated than is released via the power electronics or activation, a low equilibrium temperature materialises on the PTC thermistor element and the PTC thermistor element is in a regular operating state. When via the power electronics or activation more electric output is released and the same can then be no longer dissipated on the PTC thermistor element into the surroundings or air in the form of thermal output, the temperature of the PTC thermistor element rises up to a design limit value which is typically above 150° C. The consequence of the increase of the temperature is an increase in resistance (PTC effect) and leads to a limitation of the electric output to a level which, based on the air-side peripheral conditions, can be actually dissipated. This consumed electric output is then below the electric output released via the power electronics or activation. When this occurs, the critical operating state is present, in which the consumed electric output of the PTC thermistor element, on increasing of the released electric output, remains substantially constant since the same is limited internally by the characteristic of the PTC thermistor element and not externally via the power electronics or activation of the PTC thermistor element. In this critical operating state, the PTC thermistor element reaches a maximum temperature which, because of the non-linear electrical resistance, does not substantially rise any further even when the released electric output is increased, since more power cannot be converted any longer. A tip-over limit, which corresponds to a control signal, from which a critical operating state occurs, also depends on the external peripheral conditions (e.g. air quantity, air temperature, . . . ) and can change during the operation of the heating device. This tip-over limit can also be described or specified by a percentage value of the maximum electric output that is available.

In vehicles, which utilise conventional internal combustion engines, the electric heating devices or additional heaters are utilised during the cold-starting phase, during which the waste heat generated by the internal combustion engine is not sufficient for heating the supplied outside air to the intended temperature using a coolant-side heat exchanger. In this case electric heating devices with a heating capacity of up to 3 kW are additionally switched on, wherein the PTC thermistor elements are operated in the low-voltage range with voltages up to 60 V. In such vehicles, the inlet temperature of the heated outside air on entering the interior of the vehicle is limited by the temperature of the coolant, wherein the temperature of the coolant is typically in the range from approximately 90° to 110°.

In hybrid vehicles or vehicles that are entirely operated electrically, the waste heat of the vehicle components is not sufficient even after a start-up phase in order to ensure a desired air temperature in the interior of the vehicle in low ambient temperatures. In this case, a coolant-side heating device is omitted and instead an electric heating device with a heating output of at least 5 kW employed, wherein the PTC thermistor elements are operated in the high-voltage range with voltages of at least 60 V.

At such operating voltages, PTC thermistor elements in the critical operating state typically have a maximum temperature of more than 150°. The critical operating state can occur for example when the required heating output is lower than the available electric output. This case can occur for example in particular when the outside air already has a certain temperature, the air quantity is too low or the heating device is incorrectly operated by the vehicle occupant, in which case existing air outlet openings are manually closed for example. The electric output which cannot be dissipated into the surroundings in the form of heating output, results in a heating up of the PTC thermistor element and thus to a temperature increase of the PTC thermistor element up to the maximum temperature. This corresponds to a shifting of the tip-over limit towards smaller percentage values of the activation, so that the PTC thermistor element solely because of a change of the external peripheral conditions moves into the critical operating state without the activation or the released electric output having been changed.

The critical operating state is problematic since compared with a coolant-operated heat exchanger the inlet temperature of the heated outside air on entering the interior of the vehicle can be elevated. This causes the thermal load of the heating device to rise which in most cases is not designed for such temperatures and could thus be damaged or destroyed. In addition there is a risk for the occupants of the vehicle since such temperatures can cause burns for example.

SUMMARY

The present invention is based on the object of avoiding impermissible temperatures of the outside air to be heated using electric heating devices.

According to the invention, this problem is solved through the subjects of the independent claim(s). Advantageous embodiments are subject of the dependent claim(s).

The present invention is based on the general idea of determining the operating state of the PTC thermistor element of an electric heating device and adapting the electric output released to the PTC thermistor element in the case that the PTC thermistor element is in a critical operating state.

The method for determining the operating state of a PTC thermistor element with a regular operating state and a critical operating state according to the invention provides that a control signal pre-sets a released electric output that is available to the PTC thermistor element. This released electric output can be supplied to the PTC thermistor element via power electronics. The power electronics can supply the PTC thermistor element with an operating voltage and an operating current. The operating voltage can be provided by a voltage source. By changing the control signal, the electric output released to the PTC thermistor element can be changed. A change of the released electric output can be effected by changing the maximum released operating voltage and/or the maximum released operating current.

The method provides that the control signal is superimposed or modulated with an additional signal at least for a preset period of time which has a pre-set time profile. The preset period of time can correspond to the operating time of the PTC thermistor element. The preset period of time can also merely correspond to a fraction of the operating time of the PTC thermistor element. It is also conceivable that the superimposition with the additional signal is carried out periodically for determining operating times for a fraction of the operating time of the PTC thermistor element. The time profile of the additional signal is to mean the activation value or signal amplitude value of the additional signal as a function of the time.

Furthermore, the time profile of the consumed electric output of the PTC thermistor element is determined during the pre-set period of time. Determining the electric output consumed by the PTC thermistor element can, in the case of a pre-set operating voltage, be effected by measuring the operating current, wherein the electric output corresponds to the product of the operating voltage and the operating current.

A comparison is made between the time profile of the additional signal and the time profile of the consumed electric output of the PTC thermistor element wherein it is determined if the PTC thermistor element is in the regular operating state or in the critical operating state. The comparison can be made by a control and/or regulating device assigned to the PTC thermistor element, wherein the control and/or regulating device can be designed and/or programmed for carrying out the method. For this purpose, the control and/or regulating device can be communicatingly connected to the PTC thermistor element and/or power electronics. It can also be provided that the comparison is carried out by a control device of a vehicle, in which the PTC thermistor element can be provided.

The PTC thermistor element is in the regular operating state in the case that the time profile of the consumed electric output follows the time profile of the additional signal. The time profile of the consumed electric output follows the time profile of the additional signal when upon an increase of the additional signal an increase of the consumed electric output takes place and when upon a decrease of the additional signal a decrease of the consumed electric output occurs.

The PTC thermistor element is in the critical operating state in the case that the time profile of the consumed electric output is substantially constant or is distorted compared with the time profile of the additional signal. A distortion is present when during the predetermined period of time the time profile of the additional signal exhibits a change of the released electric output, but the time profile of the received electric output in portions does not exhibit any change or has a constant value in portions during the present period of time.

Advantageous in this method is that no additional monitoring or measurement devices are required in order to determine the operating state of the PTC thermistor element. Thus, the method can be realised cost-effectively and easily, wherein a retrofitting of already existing systems with PTC thermistor elements is also cost-effectively possible.

A further method according to the invention relates to an operating state determination of a PTC thermistor element with a regular operating state and a critical operating state, in which a control signal pre-sets a released electric output that is available to the PTC thermistor element. This electric output can be supplied to the PTC thermistor element via power electronics. The power electronics can supply the PTC thermistor element with an operating voltage and an operating current. The operating voltage can be provided by a voltage source. By changing the control signal, the electric output released to the PTC thermistor element can be changed. A change of the released electric output can be effected by changing the released operating voltage and/or the released operating current.

The method provides that the control signal is superimposed with an additional signal at least for a pre-set period of time, which has a pre-set time profile. The pre-set period of time can correspond to the operating time of the PTC thermistor element. The pre-set period of time can also correspond merely to a fraction of the operating time of the PTC thermistor element. It is also conceivable that the superimposition with the additional signal is carried out periodically for determining operating times for a fraction of the operating time of the PTC thermistor element. The time profile of the additional signal is to mean the activation value or signal amplitude value of the additional signal as a function of the time. Furthermore, the time profile of the consumed operating current of the PTC thermistor element is determined during the pre-set period of time. Determining the consumed operating current can be effected by a suitable measurement.

This is followed by a comparison between the time profile of the additional signal and the time profile of the consumed operating current of the PTC thermistor element, wherein it is determined if the PTC thermistor element is in the regular operating state or in the critical operating state. The comparison can be made by a control and/or regulating device assigned to the PTC thermistor element, wherein the control and/or regulating device can be designed and/or programmed for carrying out the method. For this purpose, the control and/or regulating device can be communicatingly connected to the PTC thermistor element and/or power electronics. It can also be provided that the comparison is made by a control device of a vehicle in which the PTC thermistor element can be provided.

The PTC thermistor element is in the regular operating state in the case that during an increase of the additional signal an increase of the consumed operating current takes place. The PTC thermistor element is in the critical operating state in the case that during an increase of the additional signal there is no increase of the consumed operating current. Furthermore, the PTC thermistor element is in the critical operating state in the case that during an increase of the additional signal there is a decrease of the operating current.

Advantageous in this method is that no additional monitoring or measurement devices are required and a comparison with a directly measurable quantity is made.

In an advantageous further development of the solution according to the invention it is provided that the additional signal is periodical and has a preset amplitude and a preset frequency, wherein the released electric output on average is substantially constant over a period of the additional signal. Here it can be provided that the amplitude of the additional signal is smaller than the amplitude of the control signal. The superimposed additional signal can be sawtooth-shaped or rectangular. Such a presetting can be effected via pulse width modulation. Since the consumed electric output of the PTC thermistor element does not change on average over time the method according to the invention can be carried out without the occupants of the interior detecting fluctuations of the entry temperature of the outside air.

In a further advantageous embodiment of the solution according to the invention it is provided that the comparison between the time profile of the additional signal and the time profile of the consumed electric output of the PTC thermistor element and/or the time profile of the consumed operating current of the PTC thermistor element is performed by means of a time series analysis. For this purpose it can be provided for example that the time profile of the quantities to be compared are stored in a memory of a control or regulating device in order to perform a comparison by means of known methods of the time series analysis. For example, a Fourier analysis of the time profile of the respective quantity can be carried out, wherein the determined Fourier coefficients are subsequently compared. It is also conceivable that a cross-correlation of the time profile of two quantities takes place. Furthermore it can be provided that the comparison produces a single numerical comparison value which is compared with a stored similarity limit value in order to determine the operating state of the PTC thermistor element. Determining the similarity limit value can be effected by means of simulation or test measurement.

A further method according to the invention relates to an operating state determination of a PTC thermistor element with a regular operating state and a critical operating state, wherein a fluid flows past the PTC thermistor element and the electric output of the PTC thermistor element is regulated. The regulation can be effected by a control and/or regulating device assigned to the PTC thermistor element, wherein the control and/or regulating device can be designed and/or programmed for carrying out the method. For this purpose, the control and/or regulating device can be communicatingly connected to the PTC thermistor element. It can also be provided that the regulation is effected by a control device of a vehicle in which the PTC thermistor element can be provided.

It is provided that a set point value of the electric output of the PTC thermistor element is compared with an actual value of the electric output of the PTC thermistor element. The set point value can be determined for example from the applied operating voltage and idealised assumption, wherein the idealised assumption assumes that the PTC thermistor element substantially has a constant electrical resistance pending the reaching of the tip-over limit. The actual value of the electric output of the PTC thermistor element can be determined with the operating voltage and by a measurement of the operating current.

The PTC thermistor element is in the regular operating state in the case that the set point value substantially corresponds to the actual value of the electric output, this also includes an actual value that is greater than the set point value. The PTC thermistor element is in the critical operating state in the case that the set point value of the electric output of the PTC thermistor element is greater than the actual value.

This method does not require any additional monitoring or measurement devices in order to determine the operating state of the PTC thermistor element. Accordingly, the method can be realised in a cost-effective and simple manner.

In a further advantageous embodiment of the solution according to the invention it is provided that the temperature of the fluid is measured downstream and upstream of the PTC thermistor element. The measurement of the temperature of the fluid can be effected using temperature sensors which for example transmit their measurement values to a control device which is assigned to the PTC thermistor element. Furthermore, a fluid mass flow which flows past the PTC thermistor element is determined. This can be determined by means of a flow measurement or for example also from the position of flaps in the intake system of a heating device.

From the set point value of the electric output of the PTC thermistor element, the temperature of the fluid upstream of the PTC thermistor element, the fluid mass flow and the heat capacity of the fluid a set point value of the temperature of the fluid downstream of the PTC thermistor element is determined. The thermal output corresponds to the product of the temperature difference of the fluid downstream and upstream, the fluid mass flow and that of the heat capacity of the fluid.

The measured temperature of the fluid downstream of the PTC thermistor element and the set point value of the temperature are compared, wherein the PTC thermistor element is in the regular operating state in the case that the measured temperature of the fluid downstream of the PTC thermistor element substantially corresponds to the set point value of the temperature. The PTC thermistor element is in the critical operating state in the case that the measured temperature of the fluid downstream of the PTC thermistor element is greater than the set point value of the temperature of the fluid.

Such a plausibility check utilising temperature measurements makes possible a redundant determination of the operating state of the PTC thermistor element.

A further method according to the invention relates to an operating state determination of a PTC thermistor element with a regular operating state and a critical operating state, wherein a fluid flows past the PTC thermistor element and the temperature of the fluid downstream of the PTC thermistor element is regulated. The regulation can be effected by a control and/or regulating device assigned to the PTC thermistor element, wherein the control and/or regulating device can be designed and/or programmed for carrying out the method. For this purpose, the control and/or regulating device can be communicatingly connected to the PTC thermistor element. It can also be provided that the regulation is effected by a control device of a vehicle in which the PTC thermistor element is provided.

The temperature of the fluid upstream of the PTC thermistor element is measured. The measurement of the temperature of the fluid can be effected with a temperature sensor which transmits the measurement value for example to a control device which is assigned to the PTC thermistor element. Furthermore, a fluid mass flow which flows past the PTC thermistor element is determined. This can be determined by means of a flow measurement or for example also from the position of flaps in the intake system of a heating device.

From the temperature of the fluid upstream of the PTC thermistor element, the preset temperature of the fluid downstream of the PTC thermistor element, the fluid mass flow and the heat capacity of the fluid the heat flow is determined. This determined heat flow corresponds to a set point value of the thermal output to be absorbed by the fluid. The determined heat flow is compared with the released electric output of the PTC thermistor element, wherein the PTC thermistor element is in the regular operating state in the case that the determined heat flow substantially corresponds to the released electric output of the PTC thermistor element. The PTC thermistor element is in the critical operating state in the case that the determined heat flow is smaller than the released electric output of the PTC thermistor element.

A further method according to the invention relates to the operating state determination of a PTC thermistor element with a regular operating state and a critical operating state, in which the temperature of the PTC thermistor element is measured and compared with a preset temperature value. The measurement of the temperature of the PTC thermistor element can be effected with a temperature sensor that is arranged on the PTC thermistor element and can be communicatingly connected to a control and/or regulating device. In the case that the measured temperature is below the preset temperature value which can for example correspond to the maximum temperature, the PTC thermistor element is in a regular operating state. The measurement of the temperature makes possible a simple and accurate detection of the operating state of the PTC thermistor element.

A further method according to the invention relates to the operation of an electric heating device of a vehicle, wherein the heating device comprises at least one PTC thermistor element for heating a fluid, wherein the PTC thermistor element is supplied with a released electric output. For this purpose, a supply with an operating voltage and an operating current can be provided. The operating voltage can be provided for example by an accumulator assigned to the vehicle.

The vehicle comprises at least one control device which is configured and/or programmed for carrying out one or more methods according to the invention. Carrying out multiple methods according to the invention, which can take place simultaneously or in succession, makes possible a redundant determination of the operating state of the at least one PTC thermistor element. This can be advantageous for example when temperature sensors are not present or damaged. Each PTC thermistor element can be assigned a separate control device wherein between the PTC thermistor element and the respective control device there can be communicating connection. A control device, which is assigned to the heating device, can also be provided, wherein between the heating device and the control device there can be a communicating connection. It is conceivable, furthermore, that the control device is communicatingly connected to a central control device of the vehicle or that the control device corresponds to the central control device of the vehicle. A control device can also include suitable power electronics.

The control device determines the operating state of the at least one PTC thermistor element according to one or more methods according to the invention, wherein the control device reduces the released electric output of the PTC thermistor element by changing a control signal in the case that the PTC thermistor element is in the critical operating state. Here, a control signal, which can be transmitted to the power electronics, can be set to a value that is smaller than the tip-over limit. By way of this, elevated inlet temperatures of the outside air on entering the interior of the vehicle are avoided. Reducing the control signal can be effected in steps, wherein for example after each reducing step a determination of the operating state of the PTC thermistor element is carried out.

In a further advantageous embodiment of the solution according to the invention it is provided that a change of the control signal is effected by means of pulse width modulation in order to steplessly regulate the control signal between a minimum value and a maximum value. Here, the minimum value can correspond to a control signal of 0% and the maximum value of the control signal 100% of the maximum available electric output of the PTC thermistor element, at which no downward-regulating of the PTC thermistor element occurs yet.

In an advantageous further development of the solution according to the invention it is provided that the control device increases the control signal of the PTC thermistor element after a preset waiting time and subsequently determines the operating state of the at least one PTC thermistor element, wherein the control device again reduces the control signal in the case that the PTC thermistor element is in the critical operating state. This can be practical when the peripheral conditions, which led to a change of the tip-over limit, change. Accordingly, the temperature of the outside air can again drop or the fluid mass flow increase which was for example temporarily reduced because of snow or leaves in the intake system.

In a further advantageous embodiment of the solution according to the invention it is provided that the operating voltage of at least 60 V is applied to the at least one PTC thermistor element in order to ensure an adequate heating of the outside air prior to entering the interior of the vehicle. Here it can be provided that the heating device supplies a heating output of at least 5 kW.

Features and advantages of the invention are obtained from the subclaims, from the drawings and from the associated figure description by way of the drawings.

It is to be understood that the features mentioned above and still to be explained in the following cannot only be used in the respective combination stated but also in other combinations or by themselves without leaving the scope of the present invention.

Preferred exemplary embodiments of the invention are shown in the drawings and are explained in more detail in the following description, wherein same reference characters relate to same or similar or functionally same components.

BRIEF DESCRIPTION OF THE DRAWINGS

There it shows, in each case schematically.

DETAILED DESCRIPTION

Figure 1:
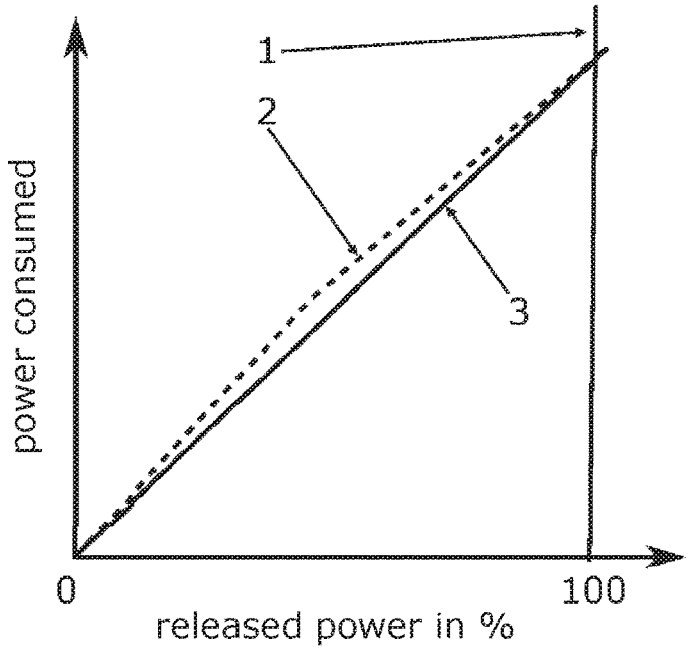
FIG. 1 shows the relationship between released and consumed electric output of a PTC thermistor element, wherein the PTC thermistor element is in the regular operating state.
Figure 2:
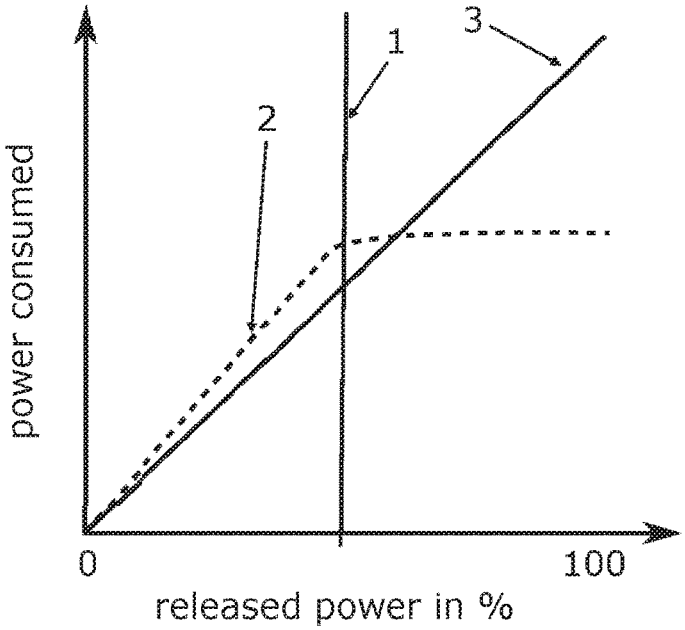
FIG. 2 shows the relationship between released and consumed electric output of a PTC thermistor element, wherein the PTC thermistor element is in the critical operating state.

FIG. 1 shows the relationship between the consumed electric output of a PTC thermistor element and that of the released electric output. The released electric output is shown in FIG. 1 and FIG. 2 as percentage value of the maximum electric output that is available. A percentage value of 0% means that the PTC thermistor element has no electric output at its disposal and is switched off. A percentage value of 100% by contrast means that the PTC thermistor element has a maximum electric output at its disposal at which no downward-regulating of the PTC thermistor element does occur as yet. Since the PTC thermistor element is in the regular operating state throughout the range of the shown operating voltage, an increase of the operating voltage always involves also an increase of the electric output of the PTC thermistor element. This state always materialises when the PTC thermistor element can emit the heating output to the surroundings to such an extent that a heating of the PTC thermistor element does not occur or only to a minor degree.

The line 1 following a vertical profile indicates a tip-over limit from which a downward-regulating of the PTC thermistor element occurs. The dashed line 2 shows the profile of the real electric output of the PTC thermistor element and the continuous line 3 represents the expected electric output of the PTC thermistor element as a function of the released electric output. The expected electric output can be determined for the regular range in that it is assumed that the PTC thermistor element in this range has a constant electrical resistance. Utilising this idealised assumption also explains the deviation between the line 2 and line 3.

In FIG. 2, the relationship between the consumed electric output of a PTC thermistor element and that of the released electric output is shown, wherein the PTC thermistor element over the range of the shown released electric output has a regular operating state and a critical operating state. The line 1 following a vertical profile describes a limit value from which a downward-regulating of the PTC thermistor element occurs.

Since compared with FIG. 1 the profile of the real electric output, which is represented by the dashed line 2, has changed, the case has occurred that the peripheral conditions or ambient conditions for the PTC thermistor element have changed. It can be for example that the supplied air, which flows past the PTC thermistor element, has a higher initial temperature and thus absorbs less heating output. It can also be that the intake system is contaminated by snow or leaves and because of this the air mass flow, flowing past the PTC thermistor element, is reduced.

Such changes of the peripheral conditions result in that the heating output made available by the PTC thermistor element is not completely dissipated via the air or the fluid. As a consequence, a heating of the PTC thermistor element occurs from a certain released electric output. From a maximum temperature of the PTC thermistor element, which is reached from the tip-over limit 1, each further increase of the released electric output no longer results in an increase of the consumed electric output. The reason for this is that the electrical resistance of the PTC thermistor element increases non-linearly from a certain temperature so that the operating current consumed by the PTC thermistor element drops with increasing operating voltage.

FIG. 2 shows the PTC thermistor element pending the reaching of the tip-over limit 1 in the regular operating state in which an increase of the released electric output results in an increase of the consumed electric output. Above the tip-over limit 1, the real electric output which is represented by the dashed line 2, does not change or only to a very small degree so that the PTC thermistor element is in the critical operating state and has reached its maximum temperature. Thus it is necessary that this operating state is initially determined and subsequently the released electric output reduced until the PTC thermistor element is again in the regular operating state. By way of this the temperature of the air heated by the PTC thermistor element is limited in order to avoid putting occupants of the vehicle or components of the heating device at risk.

Figure 3:
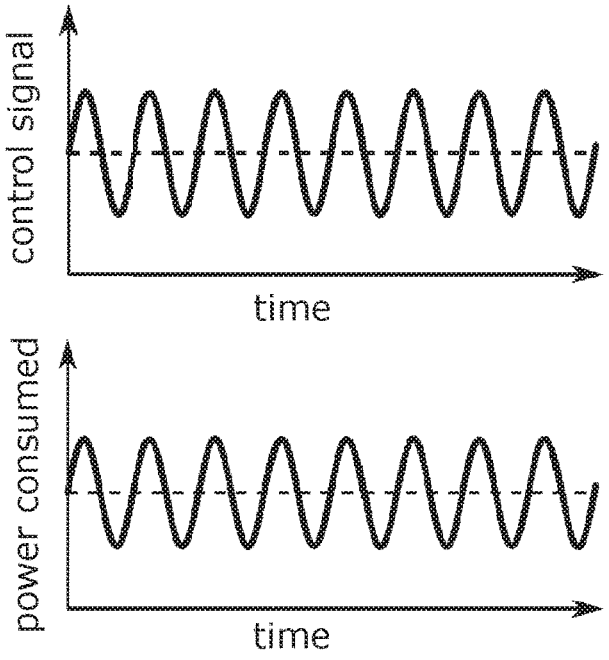
FIG. 3 shows the relationship between consumed electric output of a PTC thermistor element and the control signal, wherein the control signal is superimposed with an additional signal and the PTC thermistor element transistor element is in the regular operating state.
Figure 4:
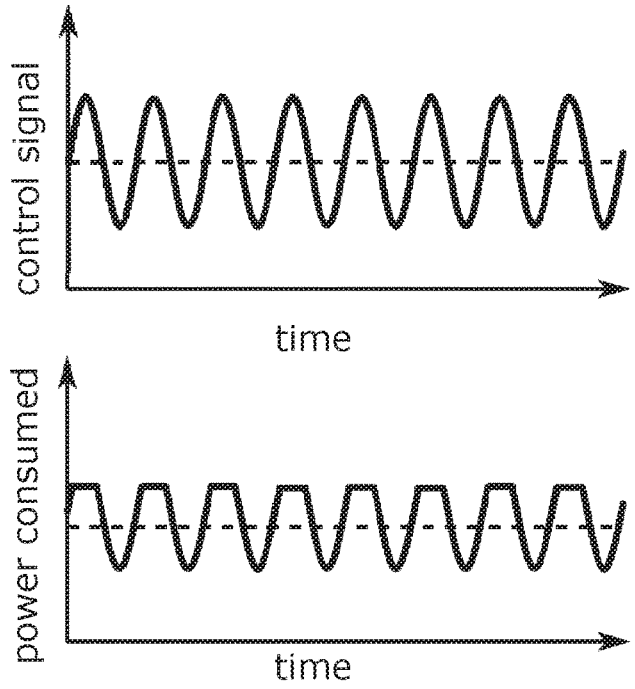
FIG. 4 shows the relationship between consumed electric output of a PTC thermistor element and the control signal, wherein the control signal is superimposed with an additional signal and the PTC thermistor element is in the critical operating state, in which distortions of the electric output occur.
Figure 5:
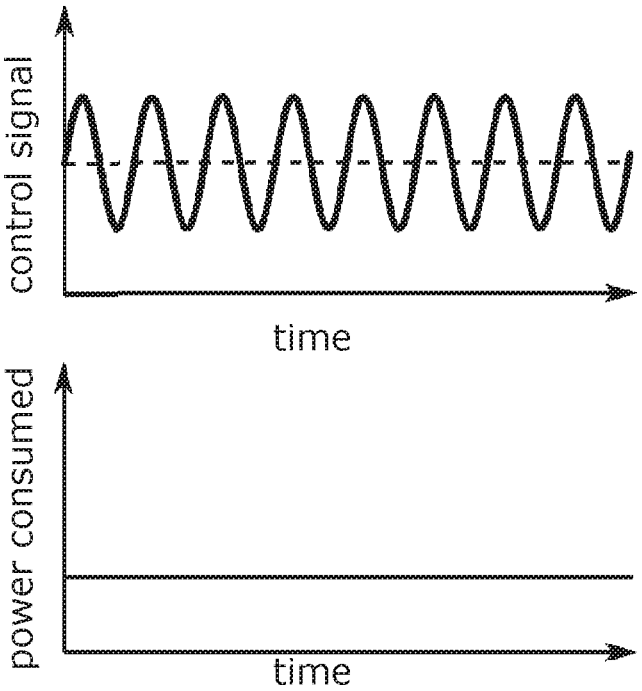
FIG. 5 shows the relationship between consumed electric output of a PTC thermistor element and the control signal, wherein the control signal is superimposed with an additional signal and the PTC thermistor element is in the critical operating state.

Determining the operating state of the PTC thermistor element is explained by way of FIG. 3, FIG. 4 and FIG. 5. In each of these figures, the time profile of a control signal is shown, wherein the dashed line corresponds to the control signal without additional signal. The continuous line shows the control signal which is superimposed with a periodical additional signal, wherein the amplitude of the additional signal can be smaller than the amplitude of the control signal. The control signal with additional signal averaged over time corresponds to the control signal without additional signal so that the released electric output averaged over time is not changed and the method according to the invention can be employed during the operation of the PTC thermistor element.

In FIG. 3, the PTC thermistor element is in the regular operating state so that the time profile of the consumed electric output follows the time profile of the additional signal. The consumed electric output averaged over time is shown by the dashed line. A comparison of the time profile of both signals can take place for example by means of correlation or Fourier analysis.

In FIG. 4, the PTC thermistor element is in the critical operating state wherein a distortion of the time profile of the consumed electric output of the PTC thermistor element occurs. A distortion is present when the control signal or the released electric output changes and the consumed electric output does not exhibit any substantial change at the same time. A distortion is always present in particular when the released electric output is near the tip-over limit 1.

In FIG. 5, the PTC thermistor element is in the critical operating state wherein the released electric output is far above the tip-over limit 1, so that the consumed electric output is substantially constant and has no correlation with the additional signal.

In the case that the PTC thermistor element is in the critical operating state the released electric output can be reduced so far until the time profile of the consumed electric output again follows the time profile of the additional signal. This can take place in steps in that the released electric output is reduced and subsequently a comparison of the two temporal signals is carried out.

The invention claimed is:

1. A method for determining an operating state of a PTC thermistor element, comprising:

pre-setting a released electric output which is available to the PTC thermistor element via a control signal;

superimposing the control signal, at least for a pre-set period of time, with an additional signal which has a pre-set time profile;

during the pre-set period of time, determining one of a time profile of a consumed electric output of the PTC thermistor element, and a time profile of a consumed operating current of the PTC thermistor element; and comparing the pre-set time profile of the additional signal and the one of the time profile of the consumed electric output of the PTC thermistor element and the time profile of the consumed operating current of the PTC thermistor element;

wherein the PTC thermistor element is in a regular operating state when one of i) the time profile of the consumed electric output follows the pre-set time profile of the additional signal and ii) upon an increase of the additional signal the consumed operating current is increased; and wherein the PTC thermistor element is in a critical operating state when one of i) the time profile of the consumed electric output one of is substantially constant and includes a distortion relative to the pre-set time profile of the additional signal and ii) upon an increase of the additional signal the consumed operating current does not increase.

2. The method according to claim 1, wherein the additional signal is a periodic signal having a preset amplitude and a preset frequency, and wherein the released electric output averaged over a period of the additional signal is substantially constant.

3. The method according to claim 1, wherein the pre-set time profile of the additional signal and the one of the time profile of the consumed electric output of the PTC thermistor element and the time profile of the consumed operating current of the PTC thermistor element are compared via a time series analysis.

4. The method according to claim 2, wherein the pre-set time profile of the additional signal and the one of the time profile of the consumed electric output of the PTC thermistor element and the time profile of the consumed operating current of the PTC thermistor element are compared via a time series analysis.

5. A method for determining an operating state of a PTC thermistor, wherein a fluid flows past the PTC thermistor element, the method comprising:

regulating an electric output of the PTC thermistor element; and comparing a set point value of the electric output of the PTC thermistor element with an actual value of the electric output of the PTC thermistor element;

wherein the PTC thermistor element is in a regular operating state when the set point value of the electric output substantially corresponds to the actual value of the electric output; and wherein the PTC thermistor element is in a critical operating state when the set point value of the electric output is greater than the actual value of the electric output.

6. The method according to claim 5, further comprising:

measuring a temperature of the fluid downstream of the PTC thermistor element and a temperature of the fluid upstream of the PTC thermistor element;

determining a fluid mass flow which flows past the PTC thermistor element;

determining a set point value of the temperature of the fluid downstream of the PTC thermistor element from the set point value of the electric output of the PTC thermistor element, the temperature of the fluid upstream of the PTC thermistor element, the fluid mass flow, and a heat capacity of the fluid; and comparing the measured temperature of the fluid downstream of the PTC thermistor element and the set point value of the temperature of the fluid downstream of the PTC thermistor element;

wherein the PTC thermistor element is in the regular operating state when the measured temperature of the fluid downstream of the PTC thermistor element substantially corresponds to the set point value of the temperature of the fluid downstream of the PTC thermistor element; and wherein the PTC thermistor element is in the critical operating state when the measured temperature of the fluid downstream of the PTC thermistor element is greater than the set point value of the temperature of the fluid downstream of the PTC thermistor element.

7. The method according to claim 5, further comprising measuring a temperature of the PTC thermistor element, and comparing the temperature of the PTC thermistor element with a preset temperature value.

8. The method according to claim 5, further comprising:

calculating the set point value of the electric output of the PTC thermistor element based on an operating voltage supplied to the PTC thermistor element and an idealized electrical resistance of the PTC thermistor; and determining the actual value of the electric output of the PTC thermistor element based on the operating voltage and a measured operating current of the PTC thermistor element.

9. A method for determining an operating state of a PTC thermistor element, wherein a fluid flows past the PTC thermistor element, the method comprising:

regulating a temperature of the fluid downstream of the PTC thermistor element;

measuring a temperature of the fluid upstream of the PTC thermistor element;

determining a fluid mass flow;

determining a heat flow based on the temperature of the fluid upstream of the PTC thermistor, the temperature of the fluid downstream of the PTC thermistor element, the fluid mass flow, and a heat capacity of the fluid; and comparing the heat flow with a released electric output of the PTC thermistor element;

wherein the PTC thermistor element is in a regular operating state when the heat flow substantially corresponds to the released electric output of the PTC thermistor element; and wherein the PTC thermistor element is in a critical operating state when the heat flow is smaller than the released electric output of the PTC thermistor element.

10. A method for operating an electric device of a vehicle, comprising:

supplying a released electric output to at least one PTC thermistor element of the electric device, the at least one PTC thermistor element configured to heat a fluid;

determining an operating state of the at least one PTC thermistor element via at least one control device of the vehicle, the at least one control device at least one of configured and programmed to determine the operating state;

reducing the released electric output supplied to the at least one PTC thermistor element via changing a control signal sent to the at least one PTC thermistor element by the at least one control device when the at least one PTC thermistor element is in a critical operating state;

increasing the control signal via the at least one control device after a preset waiting time and subsequently re-determining the operating state of the at least one PTC thermistor element; and after re-determining the operating state of the at least one PTC thermistor element, reducing the control signal via the at least one control device when the at least one PTC thermistor element is in the critical operating state.

11. The method according to claim 10, wherein the control signal is changed via pulse width modulation.

12. The method according to claim 10, wherein determining the operating state of the at least one PTC thermistor element includes:

pre-setting the released electric output supplied to the at least one PTC thermistor element via the control signal;

superimposing the control signal, at least for a predetermined period of time, with an additional signal having a pre-set time profile;

determining a time profile of a consumed electric output of the at least one PTC thermistor element during the predetermined period of time; and comparing the pre-set time profile of the additional signal and the time profile of the consumed electric output of the at least one PTC thermistor element;

wherein the at least one PTC thermistor element is in a regular operating state when the time profile of the consumed electric output follows the pre-set time profile of the additional signal; and wherein the at least one PTC thermistor element is in the critical operating state when the time profile of the consumed electric output one of is substantially constant and includes a distortion relative to the pre-set time profile of the additional signal.

13. The method according to claim 12, wherein the additional signal is a periodic signal having a preset amplitude and a preset frequency, and wherein the released electric output averaged over a period of the additional signal is substantially constant.

14. The method according to claim 12, wherein the pre-set time profile of the additional signal and the time profile of the consumed electric output of the at least one PTC thermistor element are compared via a time series analysis.

15. The method according to claim 10, wherein determining the operating state of the at least one PTC thermistor element includes:

pre-setting the released electric output supplied to the at least one PTC thermistor element via the control signal;

superimposing the control signal, at least for a pre-set period of time, with an additional signal which has a pre-set time profile;

determining a time profile of a consumed operating current of the at least one PTC thermistor element during the pre-set period of time; and comparing the pre-set time profile of the additional signal and the time profile of the consumed operating current of the at least one PTC thermistor element;

wherein the at least one PTC thermistor element is in a regular operating state when upon an increase of the additional signal the consumed operating current is increased; and wherein the at least one PTC thermistor element is in the critical operating state when upon an increase of the additional signal the consumed operating current does not increase.

16. The method according to claim 10, wherein a fluid flows past the at least one PTC thermistor, and wherein determining the operating state of the at least one PTC thermistor element includes:

regulating an electric output of the at least one PTC thermistor element; and comparing a set point value of the electric output of the at least one PTC thermistor element with an actual value of the electric output of the at least one PTC thermistor element;

wherein the at least one PTC thermistor element is in a regular operating state when the set point value of the electric output substantially corresponds to the actual value of the electric output; and wherein the at least one PTC thermistor element is in the critical operating state when the set point value of the electric output is greater than the actual value of the electric output.

17. The method according to claim 16, further comprising:

measuring a temperature of the fluid downstream of the at least one PTC thermistor element and a temperature of the fluid upstream of the at least one PTC thermistor element;

determining a fluid mass flow which flows past the at least one PTC thermistor element;

determining a set point value of the temperature of the fluid downstream of the at least one PTC thermistor element from the set point value of the electric output of the at least one PTC thermistor element, the temperature of the fluid upstream of the at least one PTC thermistor element, the fluid mass flow, and a heat capacity of the fluid; and comparing the measured temperature of the fluid downstream of the at least one PTC thermistor element and the set point value of the temperature of the fluid downstream of the at least one PTC thermistor element;

wherein the at least one PTC thermistor element is in the regular operating state when the measured temperature of the fluid downstream of the at least one PTC thermistor element substantially corresponds to the set point value of the temperature of the fluid downstream of the at least one PTC thermistor element; and wherein the at least one PTC thermistor element is in the critical operating state when the measured temperature of the fluid downstream of the at least one PTC thermistor element is greater than the set point value of the temperature of the fluid downstream of the at least one PTC thermistor element.

18. The method according to claim 10, wherein a fluid flows past the at least one PTC thermistor, and wherein determining the operating state of the at least one PTC thermistor element includes:

regulating a temperature of the fluid downstream of the at least one PTC thermistor element;

measuring a temperature of the fluid upstream of the at least one PTC thermistor element;

determining a fluid mass flow;

determining a heat flow based on the temperature of the fluid upstream of the at least one PTC thermistor, the temperature of the fluid downstream of the at least one PTC thermistor element, the fluid mass flow, and a heat capacity of the fluid; and comparing the heat flow with the released electric output of the at least one PTC thermistor element;

wherein the at least one PTC thermistor element is in a regular operating state when the heat flow substantially corresponds to the released electric output of the at least one PTC thermistor element; and wherein the at least one PTC thermistor element is in the critical operating state when the heat flow is smaller than the released electric output of the at least one PTC thermistor element.

19. The method according to claim 10, wherein determining the operating state of the at least one PTC thermistor element includes measuring a temperature of the at least one PTC thermistor element, and comparing the temperature of the at least one PTC thermistor element with a preset temperature value.

20. The method according to claim 10, wherein reducing the released electric output includes:

repeatedly reducing the released electric output in a step-wise manner until the at least one PTC thermistor element is no longer in the critical operating state; and determining the operating state of the at least one PTC thermistor element after each reduction in the released electric output.

* * * * *